United States Patent [19]

Sasaki et al.

[11] Patent Number: 4,967,237

[45] Date of Patent: Oct. 30, 1990

[54] ROLLER-DRIVING DEVICE FOR FIXING DEVICE

[75] Inventors: Yutaka Sasaki; Shinichi Murakami, both of Saitama, Japan

[73] Assignee: Fuji Xerox Co., Ltd., Tokyo, Japan

[21] Appl. No.: 245,171

[22] Filed: Sep. 15, 1988

[30] Foreign Application Priority Data

Sep. 16, 1987 [JP] Japan ..... 62-229738

[51] Int. Cl.[5] ..... G03G 15/20

[52] U.S. Cl. ..... 355/290; 219/216; 219/469; 432/60

[58] Field of Search ..... 355/282, 289, 290, 295; 219/216; 432/60; 162/271; 100/93 RP, 172, 176

[56] References Cited

U.S. PATENT DOCUMENTS 3,256,002 6/1966 Hudson ..... 355/290 X
4,339,194 7/1982 Scribner ..... 355/3 FU
4,486,091 12/1984 Cestari ..... 355/295

FOREIGN PATENT DOCUMENTS

0096450 A1 12/1983 European Pat. Off. .
60-123887 7/1985 Japan .
61-138274 6/1986 Japan .

*Primary Examiner*—Joan H. Pendegrass
*Attorney, Agent, or Firm*—Finnegan, Henderson, Farabow, Garrett, and Dunner

[57] ABSTRACT

A system for fixing a toner image to a paper has a first rotatably mounted roller having a peripheral surface for contact with the side of the paper having the toner image therein, a second rotatably mounted roller having a peripheral surface for contact with the other side of the paper in pressure engagement with the peripheral surface of the first roller, and means for rotating the first and second rollers for driving the peripheral surfaces at different velocities, the velocities differing by an amount at least sufficient to provide a slippage between the first roller and the paper held between the first and second rollers to minimize paper rucking, but differing by an amount insufficient to effectively distort the toner image.

12 Claims, 4 Drawing Sheets

ROLLER-DRIVING DEVICE FOR FIXING DEVICE

BACKGROUND OF THE INVENTION

1. Field of the Invention

The present invention relates the fixing of toner images to copy paper, and more particularly to the fixing of such toner images by the roller driven devices.

2. Description of the Related Art

An apparatus comprising a drum coated with a light-sensitive material and a fixing device is normally employed in a copying system or the like. To make a copy, a toner image is formed on the drum, which is then transferred to a paper. Then, the paper with the toner image is passed through the fixing device to fix the toner image to the paper.

In the conventional copying system as shown in FIG. 11, a document is placed on the body of the system. An optical reader projects lights to the document to read its content. Light reflected from the document illuminate on the drum 1 to form a latent image on the drum 1. The surface of the drum 1 has been electrostatically pre-charged with corotrons by corona-charging wires 2.

A developing device 3, which is disposed near the illuminated region on the drum 1, applies a toner to the electrostatically charged latent image on the drum and transforms the latent image into a visible toner image. The resulting toner image is then transferred to a paper P as corotrons are discharged from the drum 1 to the paper P by corona discharging wires 4.

The paper P with the transferred toner image is peeled off from the drum 1 and then transported to an entrance guide plate 6 by a drive mechanism 5 and then nipped, sometimes referred to hereinafter as gripped, in a fixing device 10. The fixing device 10 includes a heating roller 11 and a pressure roller 15. The rollers 11 and 15 apply simultaneously a heat and pressure to the paper P to fuse the toner of the toner image on the paper onto the paper while the paper is gripped between the rollers 11 and 15. The toner image consequently becomes permanently fixed to the paper. Then, the paper is fed through a delivery rollers 7.

In the conventional copying system, the fixing device is usually of a heating-roller type. The heating-roller type fixing device typically includes a hot heating roller and a cold pressure roller: The heating and pressure rollers simultaneously apply a heat and pressure to the paper, respectively, as the paper is nipped between the two rollers. Tungsten halogen lamps are often used as a heating source in the heating roller.

The heating-roller type fixing device is known to be safer, more cost effective, and energy efficient than other types of fixing devices. Therefore, it is most often used in the copying system and the like. The heating-roller type fixing device is disclosed in Japanese Patent Laid-Open Nos. 138274/1986 and 123877/1985, and elsewhere. In the heating roller type fixing devices previously disclosed, only one of the two rollers in the fixing device is driven, to cause the other roller to follow the driven roller. In other words, only one roller is driven to drive both rollers.

The mechanism of a typical heating-roller fixing device is shown in FIG. 12. A fixing device 10 includes a heating roller 11 and a pressure roller 15. The heating roller 11 is coated with a hard material like fluorocarbon resin or rubber. The pressure roller 15 is coated with a softer elastic material. A paper P carrying a toner image is nipped between the two rollers. Lamps 12 are incorporated in the heating roller 11 to maintain the heating roller at a constant temperature around 160° to 220° C. The heating roller 11 makes contact with the toner image side of the paper P. A heat and pressure is simultaneously applied to the paper from the heating and pressure rollers respectively, to fuse the toner image on the paper and permanently fix it to the paper.

A chain 14 is entrained with a sprocket mounted on the shaft of the heating roller 11 and a sprocket on a driving device 13 to drive the heating roller from the driven device 13. The pressure roller 15 having an arm 16 held to its shaft is disposed corresponding to the position of the heating roller 11. One end of the arm 16 is pivotally mounted to a pivot 17, and the other end is held by a spring 18. The spring 18 provides a given nipping pressure between the two rollers.

In the conventional heating-roller type fixing device, the pressure roller 15 follows the rotation of the heating roller 11 and rotates at the same peripheral velocity as the heating roller The conventional fixing device works well when small size papers like A2 or A4 size are used: the paper does not ruck up or wrinkle, and the toner image becomes satisfactorily fixed to the paper. However, when larger size papers like A0 or A1 size are used, the paper rucks and the toner image does not become satisfactorily fixed to the paper.

This situation is graphically illustrated in FIG. 13, in that the point at which the fixing characteristic curve A and the ruck characteristic curve B intersect is positioned well below a target value. Therefore, to avoid paper rucking or wrinkling for large size papers in the conventional fixing device, the nipping or gripping pressure is often reduced to the extent that the quality of the toner image fixed to the paper deteriorates, thus making high print quality copying difficult.

SUMMARY OF THE INVENTION

An object of the present invention is to provide a fixing device which can satisfactorily fix a toner image to the paper of both small and large sizes for high print quality copying.

As in the conventional fixing device, this novel fixing device also includes a hot heating roller and a cold pressure roller. However, this novel fixing device employs a differentially driven mechanism which provides a peripheral velocity of the heating roller lower than that of the pressure roller. The differentially driven mechanism has a means which slows down the rotation of the heating roller relative to that of the pressure roller, to differentiate the velocities of the two rollers and causes a small slip of the paper on the roller, but the slip is so small that the toner image still becomes satisfactorily fixed to the paper, thus making high print quality copying possible even for large size papers.

The differentially driven mechanism can also be applied to pressure-roller type fixing devices having two cold pressure rollers retained at a room temperature. These types of fixing devices are normally used in conjunction with a one-component toner or capsuled toner. Where the pressure-roller type fixing device is used, the differential drive mechanism is installed between the pressure rollers to cause the velocity of one pressure roller which makes contact with the paper on the toner image side to be lower than that of the other pressure roller.

The accompanying drawings which are incorporated in and constitute a part of the specification, illustrate several embodiments of the invention, and together with the description serve to explain the principles of the invention.

DESCRIPTION OF THE PREFERRED EMBODIMENTS

References will now be made in detail to the preferred embodiments of the invention, examples of which are illustrated in the accompanying drawings.

Figure 1:
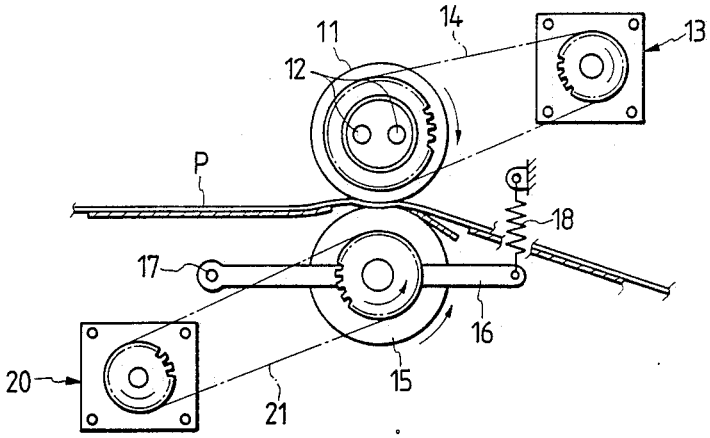
FIG. 1 is a side elevation of a heating-roller type fixing device according to the present invention.

As shown in FIG. 1, the fixing device of the present invention includes a heating roller 11 and a pressure roller 15. A pair of lamps 12 are incorporated in the heating roller 11 to maintain at the roller a constant temperature. A driving device 13 having a chain 14 entrained between the driving device and the heating roller 11 provides a given peripheral velocity to the roller. Similarly, a driving device 20 having a chain 21 provides a given velocity to the pressure roller 15. The shaft of the roller 15 is connected to an arm 16 having a first end held by a pivot 17, and the second end retained by a spring 18. The pressure roller 15 provides a given nipping or gripping pressure between the heating and pressure rollers.

Figure 2:
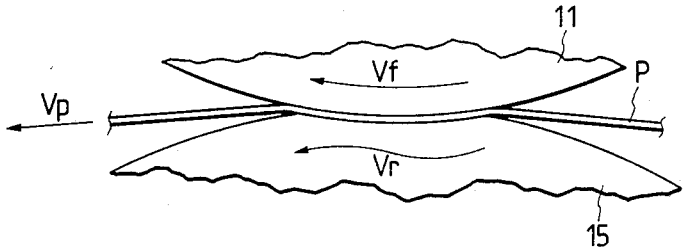
FIG. 2 is a diagram illustrating the relation of the velocity of the paper movement to the peripheral velocity of a heating roller and a pressure roller in a fixing device.

In FIG. 2, the velocity relation of the paper to the rollers for the fixing device of the present invention is defined in terms of velocity parameters: $V_f$, $V_r$, and $V_p$ are defined as the velocity of the heating roller, the pressure roller, and the paper movement, respectively. Parameter a is further defined as: $\alpha=(V_p-V_f)/V_p$.

The rollers would be ideally driven, if the relation $V_r= V_p>V_f$ could be established. However, in practice, the slip of the paper on the rollers cannot be completely eliminated and so the relation $V_r\geqq V_p$ holds.

The range of values of a is set in relation to the toner image density. The toner image density is defined as the coverage ratio of the toner image over the entire paper area. When the toner image density is in the range between 2–3% and 100% (i.e. solid black), the value of $\alpha$ is set at 0.02–0.03. When the toner image density is 0%, (i.e. almost white), the value of $\alpha$ is set at 0.02–0.1.

However, the value of o would be set differently if the paper quality, the nipping pressure, or the technology used were different. In extreme cases, the value of $\alpha$ is set at any value within the range, $0<\alpha<1$, where n is an infinitesmal number. In practice, judging from the disorder of the image a good copy can be created by setting the value of $\alpha$, at less than about 0.05.

As previously discussed, the velocity relationship of $V_r\geqq V_p>V_f$ in the fixing device is desired to avoid paper ruck ups. In the conventional fixing device, the paper P moves at the velocity $V_p$ which is almost equal to the velocity $V_r$ of the pressure roller 15 and the heating roller 11 is rotated synchronously with the pressure roller 15, thus resulting in $V_r\approx V_p\approx V_f$. In this situation, the paper will be adversely affected by friction between the heating roller 11 and the pressure roller 15 thus reducing the degree of freedom of movement given to the paper nipped between the rollers to avoid paper rucking. As the nipping pressure between the rollers increases, the aforesaid degree of freedom will further be reduced.

However, if the velocity of the paper movement, $V_p$, is set higher than that of the heating roller, $V_f$, a slip will take place between the paper and roller, and friction between the paper and the roller will be reduced. This will increase the degree of freedom given to the paper to avoid paper rucking.

Figure 3:
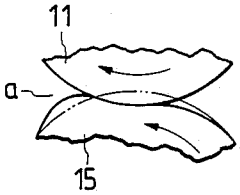
FIGS. 3 through 5 are diagrams illustrating the extent of which the differential peripheral velocities of a heating roller and a pressure roller in a fixing device affects the condition of the paper nipped between the rollers.
Figure 4:
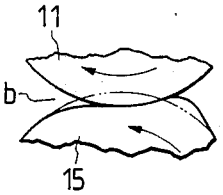
Figure 5:
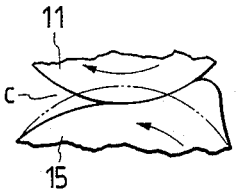

The condition under which the paper is subject when nipped between the rollers in the fixing device depends on whether only one or both of the two rollers are driven as shown in FIGS. 3–5. In FIG. 3, only the heating roller is driven, and the pressure roller follows it. Both of the rollers rotate at a same peripheral velocity; In FIG. 4, the pressure roller is driven, and the heating roller follows it. Again, both of the rollers rotate at a same peripheral velocity; In FIG. 5, both of the rollers are driven at two different velocities.

A nipping force c shown in FIG. 5, is the greatest where both of the rollers are driven, a force b shown in FIG. 4, the smaller where only the pressure roller is driven and a force a shown in FIG. 3, the smallest where only the heating roller is driven. Where the toner image is to be fixed to large size papers, force relationship, $a<b<c$ is established to allow stabilization from the time when the paper is started to be axially nipped to when it starts reacting to the nipping action.

The differentially driven mechanism of the present invention is adapted to make the fixing condition optimal to avoid paper rucking for large size papers. Several differentially driven mechanisms which satisfy this optimal fixing condition are shown in FIGS. 1, and 6–9.

Figure 6:
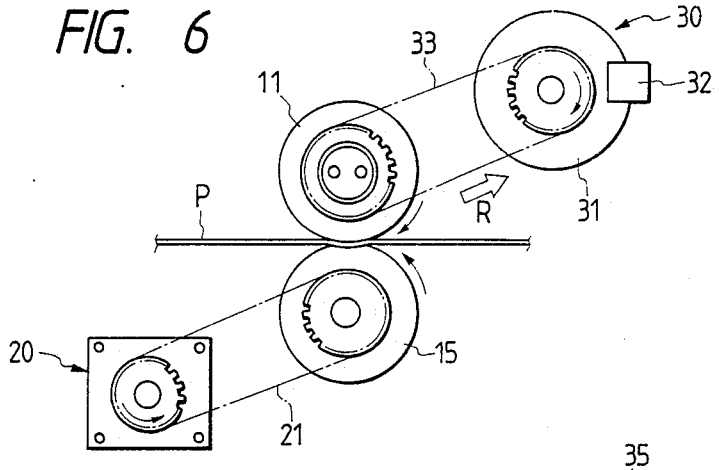
FIGS. 6 through 8 are a side elevations of respective heating type fixing devices each having a heating roller equipped with a different, type retarding device.
Figure 7:
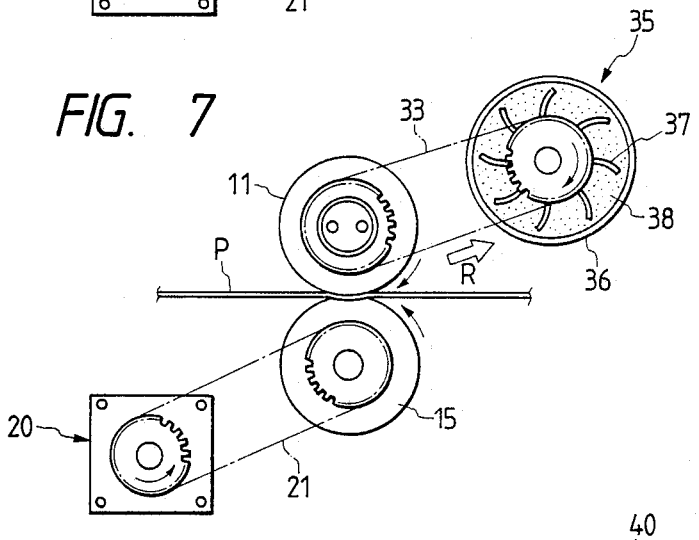
Figure 8:
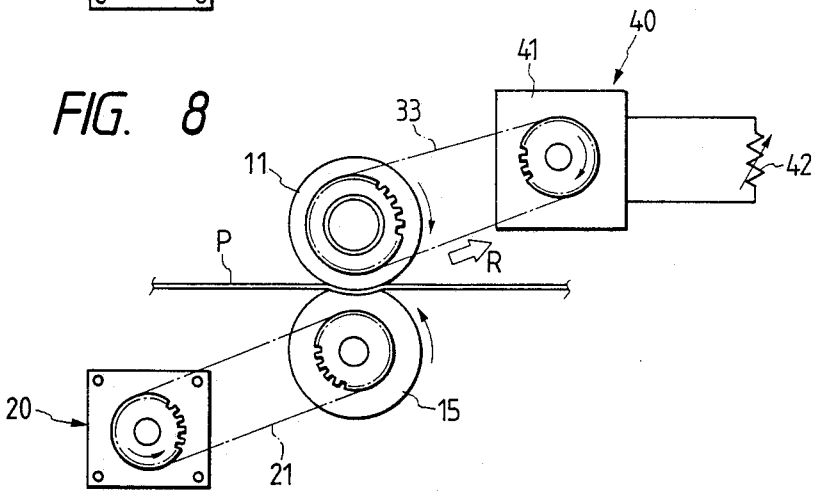

In FIGS. 6–8, a pressure roller 15 is driven by a driving device 20 having a chain 21 entrained with the roller. A heating roller 11 is caused to follow the pressure roller 15. However, to set the peripheral velocity of the heating roller 11 lower than that of the pressure roller, retarding devices 30, 35 and 40 are installed in respective driving devices in FIGS. 6–8, for the heating roller 11.

In FIG. 6, a chain 33 is entrained with a sprocket mounted to the shaft of the heating roller 11. The heating roller 11 is connected to a disk retarding device 30 consisting of a disk 31 and a pad 32. A differentially driven mechanism is formed whereas the retarding device 30 imparts a resistance R to the rotation of the heating roller 11 to make the peripheral velocity of the heating roller lower than that of the pressure roller, thus rendering the peripheral velocity of the two rollers different. The retarding device used in this example is not limited to the disk type devices. Other mechanical type retarding devices can be used instead.

In FIG. 7, a fluid brake or retarding device 35 is used instead of a mechanical type retarding device. The retarding device 35 includes a casing 36 containing oil 38 inside and a rotor 37 having fins protruding from it and utilizes the viscous drag of a fluid. The shaft of the rotor 37 having a chain 33 entrained with the shaft of the pressure roller rotates the rotor 37 inside the casing 36 when the heating roller 11 is driven by the pressure roller 15. The oil imparts a given torque resistance R to the rotor 37 as the rotor is rotated, thus reducing the peripheral velocity of the heating roller 11. The oil contained in the casing 36 must be stable to maintain a given viscosity or resistance, when stirred.

Referring next to FIG. 8, an electrical type braking or retarding device 40 includes a retarding motor 41 interlocking with the heating roller and imparts a resistance R to the heating roller 11. When the heating roller is rotated, the retarding motor 41 acts as a dynamo, dissipating power generated through a variable resistor 42.

In all of the aforesaid retarding devices, wherein the differential driven mechanism makes use of a mechanical device in which the brake pod is pressed against a disk, fluid density control means, and electrical resistance control means, respectively, a given resistance R is imparted to the heating roller which rotates in synchronism with the pressure roller. The peripheral velocity of the heating roller is varied to the extent that the value of parameter a is set below 0.05 to avoid paper rucking for high print quality copying.

Figure 9:
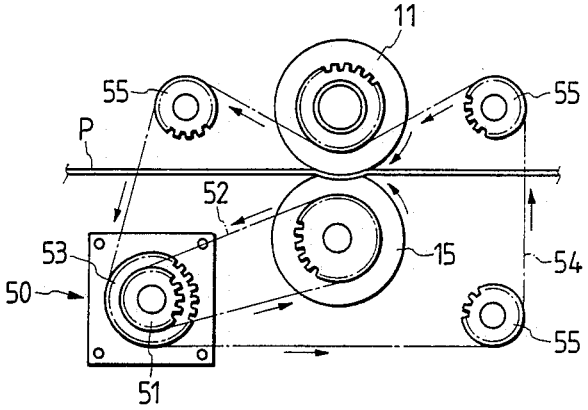
FIG. 9 is a side elevation of a fixing device in which a heating roller and a pressure roller are driven by a common driving device at two different peripheral velocities.

The differentially driven mechanisms may also include the driving device and the retarding device as shown in FIG. 9. In FIG. 9, the driving device 50 includes sprockets 51 and 53 mounted on its shaft having a different number of teeth to make the rollers rotated at different velocities by a common driving device. The sprockets 51 and 53 drive, via chain 52, and chain 53 and idler sprockets 55, the pressure roller 15 and the heating roller 11, respectively.

In FIG. 9, the peripheral velocities of the rollers are set to two different values in accordance with the number of teeth and/or the diameter of the sprockets of the driving device and the rollers to form a differentially driven mechanism. The differentially driven mechanism of this type does not require fine adjustments and can be fabricated with general-purpose parts and easily maintained.

Figure 10:
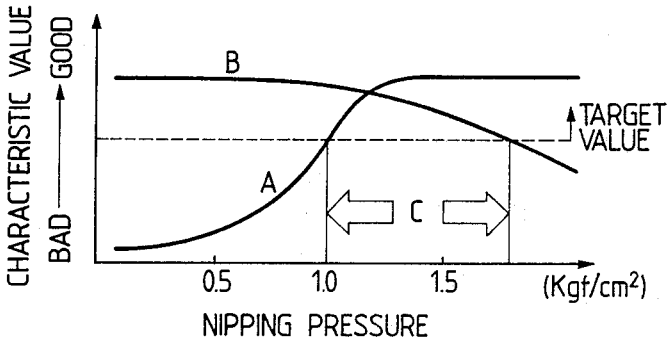
FIG. 10 is a diagram illustrating the relation of the fixing and paper ruck characteristics in reference to the nipping pressure produced by a differentially driven mechanism according to the present invention.
Figure 11:
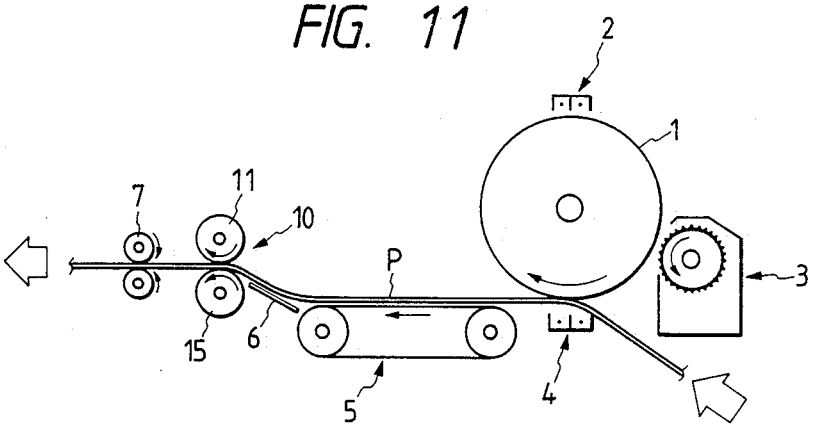
FIG. 11 is a side elevation of a conventional copying machine.
Figure 12:
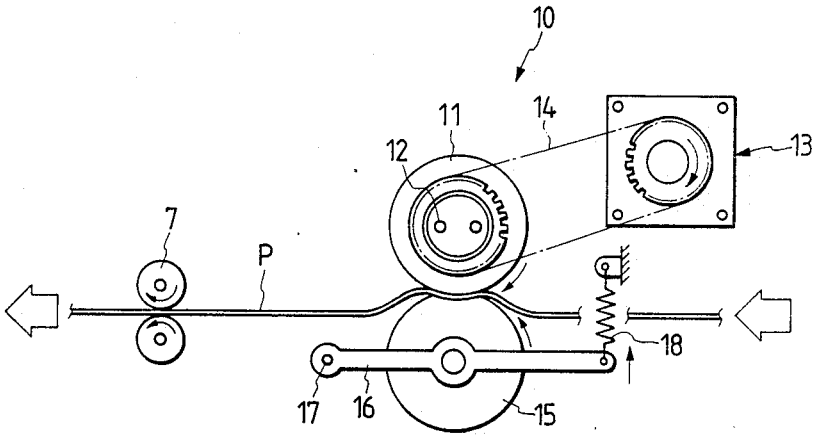
FIG. 12 is a side elevation of a conventional fixing device.
Figure 13:
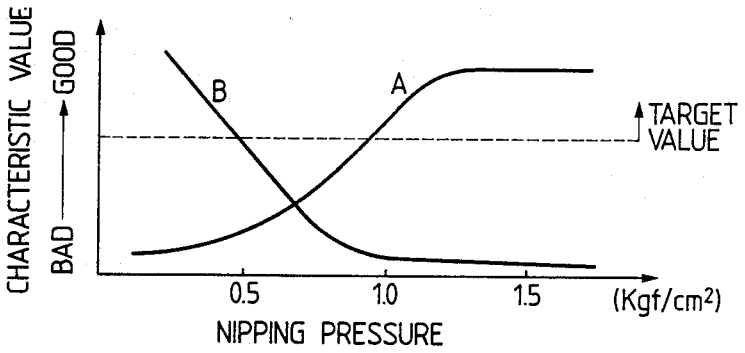
FIG. 13 is a diagram illustrating the relation of the fixing and paper ruck characteristics in reference to the nipping pressure of a conventional fixing device shown in FIG. 12.

As shown in FIG. 10, when the differentially driven mechanism of the present invention is used, the point at which the fixing and ruck characteristic curves A and B intersect is positioned well above a target value so that a wide range of nipping pressures C can be used with optimal fixing characteristics. Therefore, even when the nipping pressure is relatively high, the paper will not ruck and the toner image will be satisfactorily fixed to the paper.

Furthermore, the fixing device using a differentially driven mechanism also provides a good fixing characteristics for small size papers such as A4 size as it does for large size papers such as A0 or A2 size.

In each illustrated example of the present invention, the differentially driven mechanism consists essentially of a driven pressure roller and a heating roller which follows the pressure roller. The speed at which the heating roller is rotated is set lower than that of the pressure roller. Thus the heating roller is caused to slip on the surface of the paper. This in turn causes the velocities of the heating roller and the paper movement different so that the coefficient of friction between the paper and the rollers is reduced, and the degree of freedom given to the paper held between the rollers is increased.

In another embodiment of the present invention where both the heating and pressure rollers are driven at different velocities, a slip is also produced between the paper and the heating roller to avoid paper rucking. In both embodiments, the differentially driven mechanism is capable of setting and controlling the extent of the velocity difference between the rollers.

The fixing device with the differentially driven mechanism of the present invention can be fabricated more economically and more energy efficient than the conventional fixing device. However, the present invention is not limited only to the aforesaid differentially driven mechanisms. Differentially driven mechanisms of a radically different structure can be conceived to provide a differential velocity between the rollers.

In the aforesaid embodiments of the present invention, the fixing device is of the heating-roller type. The present invention is not limited to the heating-roller type. It can also be applied to a pressure-roller fix the toner image to the paper by the application of pressure.

This pressure-roller type fixing device is employed to fix an image consisting of fixing devices, the velocity of one pressure roller making contact on the toner image side of the paper is set lower than that of the other pressure roller. A good fixing characteristics can be obtained also in this type of fixing devices. The pressure-roller type fixing device can also employ all of the differentially driven mechanisms discussed above in connection with the heating-roller type fixing devices.

In the novel fixing device of the present invention, a slip is produced between the paper and the rollers as the nipping pressure is increased to a level at which the fixing device shows a good fixing characteristics for large size papers. The amount of the slip can be set so the image is not affected by the slip. The degree of freedom of movement given to the paper held between both rollers can be increased. The condition of the paper can be modified by the resilience of the paper itself before the paper rucks up. Hence, it can fix a toner image well to a large size of paper, such as the A-0 size.

It will be apparent to those skilled in the art that numerous modifications and variations can be made in the fixing devices and method of the present invention without departing from the scope or spirit of the invention. Thus, it is intended that the present invention cover the modifications and variations provided they come within the scope of the appended claims and their equivalents.

What is claimed is:

1. A system for fixing a toner image to a paper comprising:

a first rotatably mounted roller having a peripheral surface for contact with the side of the paper having the toner image thereon for heating the toner image;

a second rotatably mounted roller having a peripheral surface for contact with the other side of the paper in pressure engagement with said peripheral surface of said first roller for applying nipping pressure simultaneously with the heating; and means for rotating said first and second rollers respectively for driving said peripheral surfaces at different velocities, said velocities differing by an amount at least sufficient to provide a slippage between said first roller and the paper held between said first and second rollers to minimize paper rucking, but differing by an amount insufficient to effectively distort the toner image.

2. The system of claim 1, wherein the means for rotating the first and second rollers include means operative to rotate the first roller at a peripheral velocity slower than the second roller.

3. The system of claim 2, wherein said means for rotating the first roller includes means for imparting a resistance to the rotation of the first roller.

4. The system of claim 3, wherein the imparting means includes a mechanical braking device for frictionally slowing the rotation of the first roller.

5. The system of claim 3, wherein the imparting means includes a fluid control device for slowing the rotation of the first roller.

6. The system of claim 3, wherein the imparting means includes an electrical generator having one of the moving parts connected to the first roller for providing an electrical drag on the first roller.

7. A system of claim 1, wherein the means for rotating said first and second rollers includes a respective first and second drive roller each having sprockets with a different number of teeth, a drive chain entraining each of the drive rollers; and a common means driving said drive rollers, for driving said rollers to rotate at different peripheral velocities.

8. A method of fixing a toner image to a paper comprising:

urging first and second rotatably mounted rollers against one another for conveying said paper between the peripheral surfaces of the rollers at a predetermined pressure upon rotation of the rollers;

forcing said sheet of paper having said toner image on at least one side between said first and second rollers, said toner image side of said paper physically engaging said first roller;

rotating said first roller in one direction at a first peripheral velocity;

heating the toner image;

rotating said second roller in the opposite direction at a selected second peripheral velocity higher than said first peripheral velocity effective to submit a slippage between said paper and one of said rollers sufficient to minimize paper rucking but insufficient to distort said toner image; and applying nipping pressure on the paper simultaneously with the heating.

9. A system for fixing a toner image to a paper comprising:

a first rotatably mounted roller having a peripheral surface for contact with the side of the paper having the toner image thereon;

a second rotatably mounted roller having a peripheral surface for contact with the other side of the paper in pressure engagement with said peripheral surface of said first roller; and means for rotating said first and second rollers respectively for driving said peripheral surfaces at different velocities, said velocities differing by an amount at least sufficient to provide a slippage between said first roller and the paper held between said first and second rollers to minimize paper rucking, but differing by an amount insufficient to effectively distort the toner image, said means for rotating said first and second rollers including a respective first and second drive roller each having sprockets with a different number of teeth, a drive chain entraining each of the drive rollers, and a common means driving said drive rollers, for driving said first and second rollers to rotate at different peripheral velocities.

10. The system of claim 9, wherein the means for rotating the first and second rollers respectively include means operative to rotate the first roller at a peripheral velocity slower than the second roller.

11. A system for fixing a toner image to a paper comprising:

a first rotatably mounted roller having a peripheral surface for contact with the side of the paper having the toner image thereon;

a second rotatably mounted roller having peripheral surface for contact with the other side of the paper in pressure engagement with said peripheral surface of said first roller; and means for rotating said first and second rollers respectively for driving said peripheral surfaces at different velocities, said velocities differing by an amount at least sufficient to provide a slippage between said first roller and the paper held between said first and second rollers to minimize paper rucking, but differing by and amount insufficient to effectively distort the toner image, said rotating means including a fluid control device for imparting a resistance to the rotation of the first roller to rotate the first roller at a peripheral velocity slower than the second roller.

12. A system for fixing a toner image to a paper comprising:

a first rotatably mounted roller having a peripheral surface for contact with the side of the paper having the toner image thereon;

a second rotatably mounted roller having a peripheral surface for contact with the other side of the paper in pressure engagement with said peripheral surface of said first roller; and means for rotating said first and second rollers respectively for driving said peripheral surfaces at different velocities, said velocities differing by an amount at least sufficient to provide a slippage between said first roller and the paper held between said first and second rollers to minimize paper rucking, but differing by an amount insufficient to effectively distort the toner image, said rotating means including an electrical generator having one of the moving parts connected to the first roller for providing an electrical drag on the first roller to rotate the first roller at a peripheral velocity slower than the second roller.

* * * * *

UNITED STATES PATENT AND TRADEMARK OFFICE

CERTIFICATE OF CORRECTION

PATENT NO. : 4,967,237

DATED : October 30, 1990

INVENTOR(S) : Yutaka Sasaki et al.

It is certified that error appears in the above-identified patent and that said Letters Patent is hereby corrected as shown below:

Column 3, line 16, delete "a".

Column 4, line 12, change "$V_{fin}$" to —$V_f$ in—.

Claim 11, column 8, line 27, after "having" insert --a--.

Claim 11, column 8, line 37, change "and" to --an--.

Signed and Sealed this

First Day of September, 1992

*Attest:*

DOUGLAS B. COMER

*Attesting Officer*

*Acting Commissioner of Patents and Trademarks*